US009291028B2

(12) United States Patent
Hiorth et al.

(10) Patent No.: US 9,291,028 B2
(45) Date of Patent: Mar. 22, 2016

(54) PLUGGING DEVICE

(75) Inventors: Espen Hiorth, Trondheim (NO); Steinar Georgsen, Trondheim (NO); Christian Malvik, Heimdal (NO)

(73) Assignee: Interwell Technology AS, Ranheim (NO)

( * ) Notice: Subject to any disclaimer, the term of this patent is extended or adjusted under 35 U.S.C. 154(b) by 530 days.

(21) Appl. No.: 13/993,747

(22) PCT Filed: Nov. 21, 2011

(86) PCT No.: PCT/EP2011/070527

§ 371 (c)(1),
(2), (4) Date: Aug. 19, 2013

(87) PCT Pub. No.: WO2012/079913

PCT Pub. Date: Jun. 21, 2012

(65) Prior Publication Data

US 2013/0333875 A1 Dec. 19, 2013

(30) Foreign Application Priority Data

Dec. 15, 2010 (NO) ..... 20101759

(51) Int. Cl.
*E21B 33/128* (2006.01)
*E21B 33/12* (2006.01)

(52) U.S. Cl.
CPC ..... *E21B 33/128* (2013.01); *E21B 33/1208* (2013.01); *E21B 33/1216* (2013.01)

(58) Field of Classification Search
CPC ..... E21B 23/02; E21B 23/06; E21B 33/128
See application file for complete search history.

(56) References Cited

U.S. PATENT DOCUMENTS 2,216,336 A * 10/1940 Barnes ..... E21B 33/12 166/130

(Continued)

FOREIGN PATENT DOCUMENTS

EP 1 116 860 A1 7/2001

OTHER PUBLICATIONS

International Search Report issued in PCT/EP2011/070527 mailed Nov. 19, 2012 (2 pages).

(Continued)

*Primary Examiner* — William P Neuder
(74) *Attorney, Agent, or Firm* — Osha Liang LLP

(57) ABSTRACT

The present invention relates to a plugging device (1), comprising a packer device (4) for pressure tight sealing of a pipe. The packer device (4) comprises a cone device (10) comprising a first cone (12) and a second cone (14), each having their base faced towards each other and each comprising a tapering surface (12*a*, 14*a*). A first packer supporting device (20) is provided on a first side of the cone device (10), a second packer supporting device (22) is provided on a second side of the cone device (10) and a packer body (50) provided is between the first packer supporting device (20) and the second packer supporting device (22). The first and second packer supporting devices (20, 22) comprise supporting arms (24) having a first end (24*a*) movably connected to the plugging device (1) and a second end (24*b*) connected to either a front supporting element (30) or a rear supporting element (40). A sliding surface is provided on the first and second packer supporting device (20, 22) for sliding up and down the tapering surface (12*a*, 14*a*) of the first or second cone (12, 14), thereby bringing the packer device (4) between its expanded and retracted positions respectively. The front supporting elements (30) and the rear supporting elements (40) comprise front surfaces (32, 42), where the front surfaces (32, 42) are faced towards the base of the first and second cones (12, 14) and provide an extrusion barrier surface for the packer body (50) in the expanded position.

17 Claims, 10 Drawing Sheets

(56) References Cited

U.S. PATENT DOCUMENTS

| | | | | |
|---|---|---|---|---|
| 3,526,277 | A * | 9/1970 | Scott | E21B 33/1265 166/121 |
| 3,526,278 | A * | 9/1970 | Scott | E21B 34/125 166/152 |
| 7,178,602 | B2 | 2/2007 | Hiorth et al. | |
| 7,290,603 | B2 | 11/2007 | Hiorth et al. | |
| 7,779,905 | B2 | 8/2010 | Carisella et al. | |
| 7,900,696 | B1 * | 3/2011 | Nish | E21B 33/1294 166/133 |
| 2004/0003928 | A1 | 1/2004 | Frazier | |
| 2004/0069502 | A1 | 4/2004 | Luke | |

OTHER PUBLICATIONS

Written Opinion issued in PCT/EP2011/070527 mailed Nov. 19, 2012 (7 pages).

Norwegian Search Report issued in Norwegian Application No. 20101759 dated Jul. 10, 2011 (2 pages).

* cited by examiner 1
20
24
12a
12b
42

PLUGGING DEVICE

CROSS-REFERENCE TO RELATED APPLICATIONS

This application is a National Stage application of International Patent Application No. PCT/EP2011/070527, filed on Nov. 21, 2011, entitled "PLUGGING DEVICE," which claims priority pursuant to 35 U.S.C. §119(a) to Norwegian Patent Application No. 20101759, filed on Dec. 15, 2010. The priority applications are hereby incorporated by reference in their entirety.

FIELD OF THE INVENTION

The present invention relates to a plugging device.

BACKGROUND OF THE INVENTION

Several types of plugging devices for plugging of hydrocarbon well pipes are known. In U.S. Pat. No. 7,178,602 (also in the name of Brønnteknologiutvikling) it is shown a plugging device having an anchoring device with gripping elements for anchoring the plugging device to the inner casing of the well pipe to prevent movement of the plugging device. The plugging device also comprises an expandable packer element for sealing the well pipe. The packer element is supported by a link connection for compressing and thereby expanding the packer element radially.

A so-called high expansion plugging device has a relatively narrow diameter in retracted state, allowing the plugging device to pass restrictions in the well pipe. At the same time, it has a relatively large diameter in expanded state to seal the well pipe.

In some subsea hydrocarbon well pipes, there is a need for plugging devices which may withstand high pressures and high temperatures for a long time. This puts a lot of stress to the packer element being compressed during the sealing period. Moreover, it is a requirement that the plugging device is retrievable from the well after use. Often there is a risk that the packer element becomes deformed during the expansion, which may cause problems with retrieving the plugging device past narrow restrictions in the well pipe.

The object of the invention is to provide a plugging device which is capable of withstanding a high pressure and a high temperature for a long time and still being able to be retracted after use.

SUMMARY OF THE INVENTION

The present invention relates to a plugging device comprising a packer device for pressure tight sealing of a pipe, the packer device comprising:

- a cone device comprising a first cone and a second cone, each having their base faced towards each other and each comprising a tapering surface;
- a first packer supporting device provided on a first side of the cone device;
- a second packer supporting device provided on a second side of the cone device;
- a packer body provided between the first packer supporting device and the second packer supporting device;

where the first and second packer supporting devices comprise supporting arms having a first end movably connected to the plugging device and a second end connected to either a front supporting element or a rear supporting element;

where a sliding surface is provided on the first and second packer supporting device for sliding up and down the tapering surface of the first or second cone, thereby bringing the packer device between its expanded and retracted positions respectively;

where the front supporting elements and the rear supporting elements comprise front surfaces, where the front surfaces are faced towards the base of the first and second cones and provide an extrusion barrier surface for the packer body in the expanded position.

In one aspect, every second supporting arm is connected to the respective front supporting elements and every second supporting arm is connected to the respective rear supporting elements.

In one aspect, the second end of the supporting arms is pivotably connected to the respective front supporting element or the respective rear supporting element.

In one aspect, the sliding surface comprises a sliding surface provided on each front supporting element and a sliding surface provided on each rear supporting element.

In one aspect, the first and second packer supporting device are configured so that each front surface of the front supporting elements of the first packer supporting device is faced towards the front surface of the rear supporting elements of the second packer supporting device in the expanded position.

In one aspect, a guiding system is provided for preventing relative rotation between the first and second packer supporting devices during expansion and retraction.

In one aspect, the packer body comprises packer elements provided on the front surface of each front supporting element.

In one aspect, the front surface of the rear supporting element is supporting rear surfaces of two adjacent front supporting elements both in the retracted and expanded positions.

In one aspect, the front surface of the rear supporting element is provided at least partially behind the rear surfaces of two adjacent front supporting elements in the retracted position.

In one aspect, the front surface of the front supporting elements is at least partially curved.

In one aspect, a cone packer element is provided between the base of the first cone and the base of the second cone.

In one aspect, the first cone and the second cone is displaceable in an axial direction with respect to each other.

In one aspect, a connection device is provided for radial orientation of the first cone in relation to the second cone.

In one aspect, the connection device limits the axial displacement of the first cone in relation to the second cone.

In one aspect, a retracting device is provided for pressing the first and/or second packer supporting devices from the expanded position to the retracted position.

DETAILED DESCRIPTION

In the following, embodiments of the present invention will be described in detail with reference to the enclosed drawings, where:

Figure 12C:
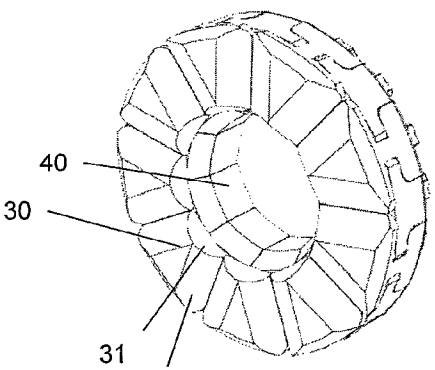
Figure 12B:
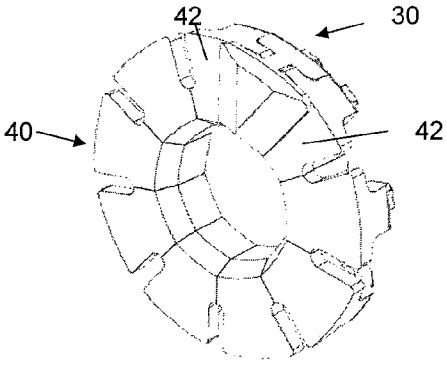
Figure 12A:
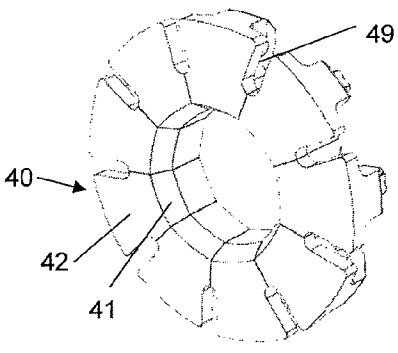
Figure 13C:
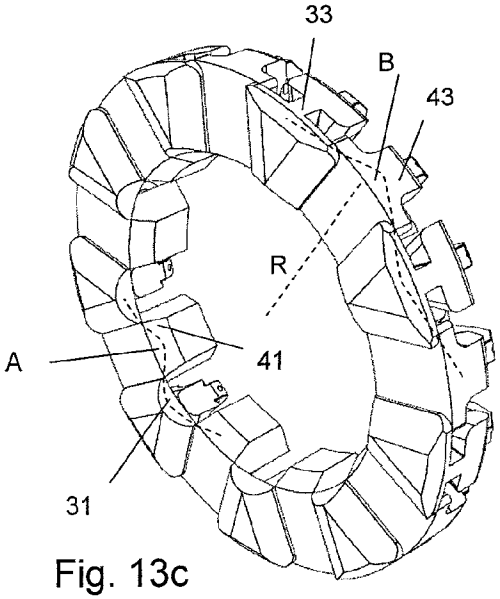
Figure 13B:
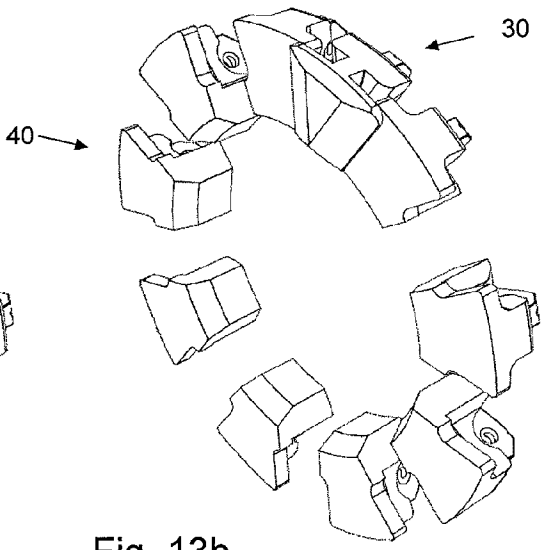
Figure 13A:
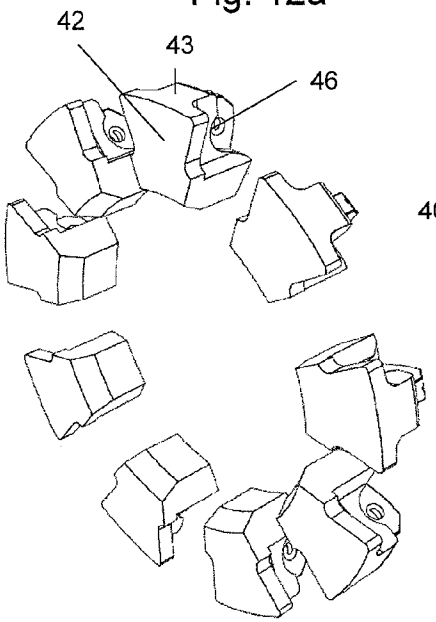
Figure 15:
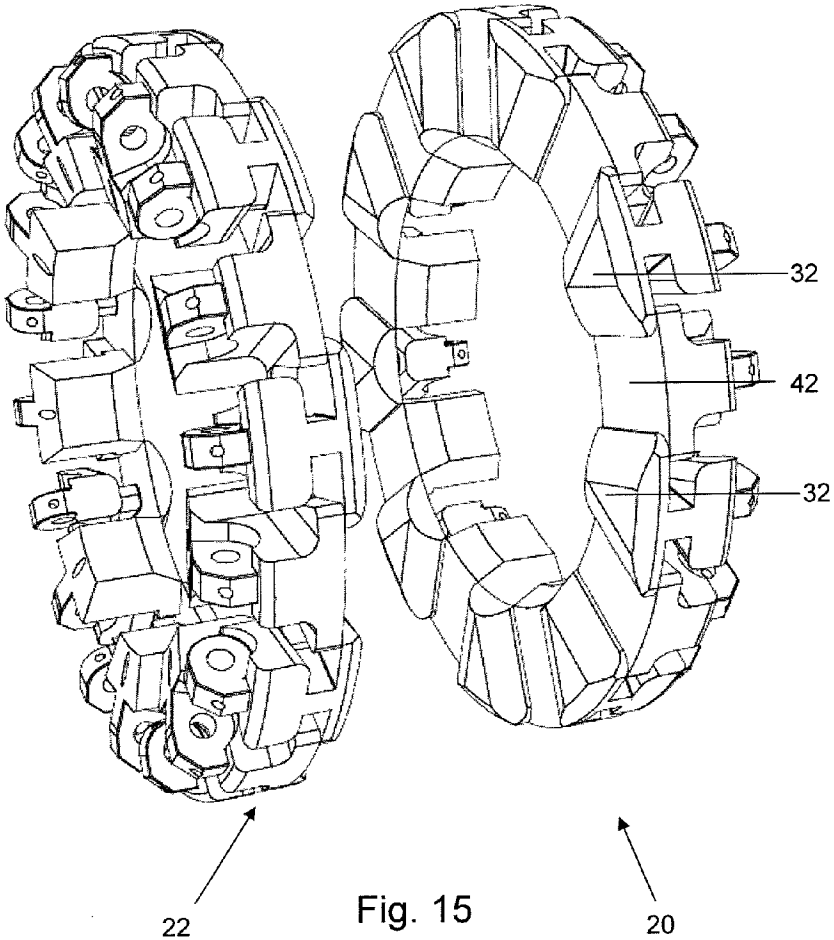
Figure 14:
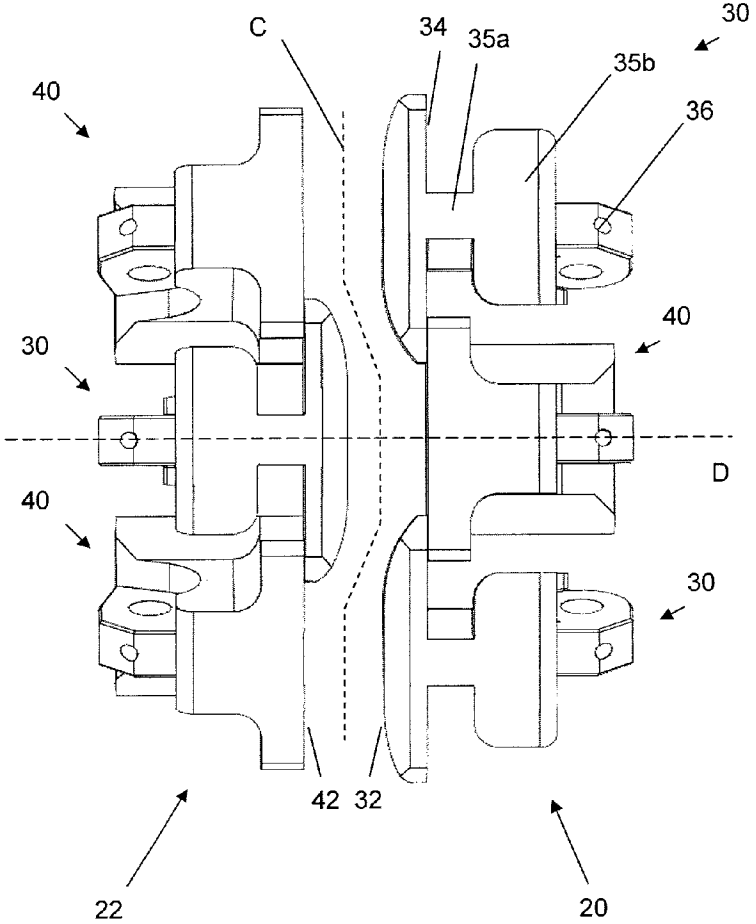
Figure 16:
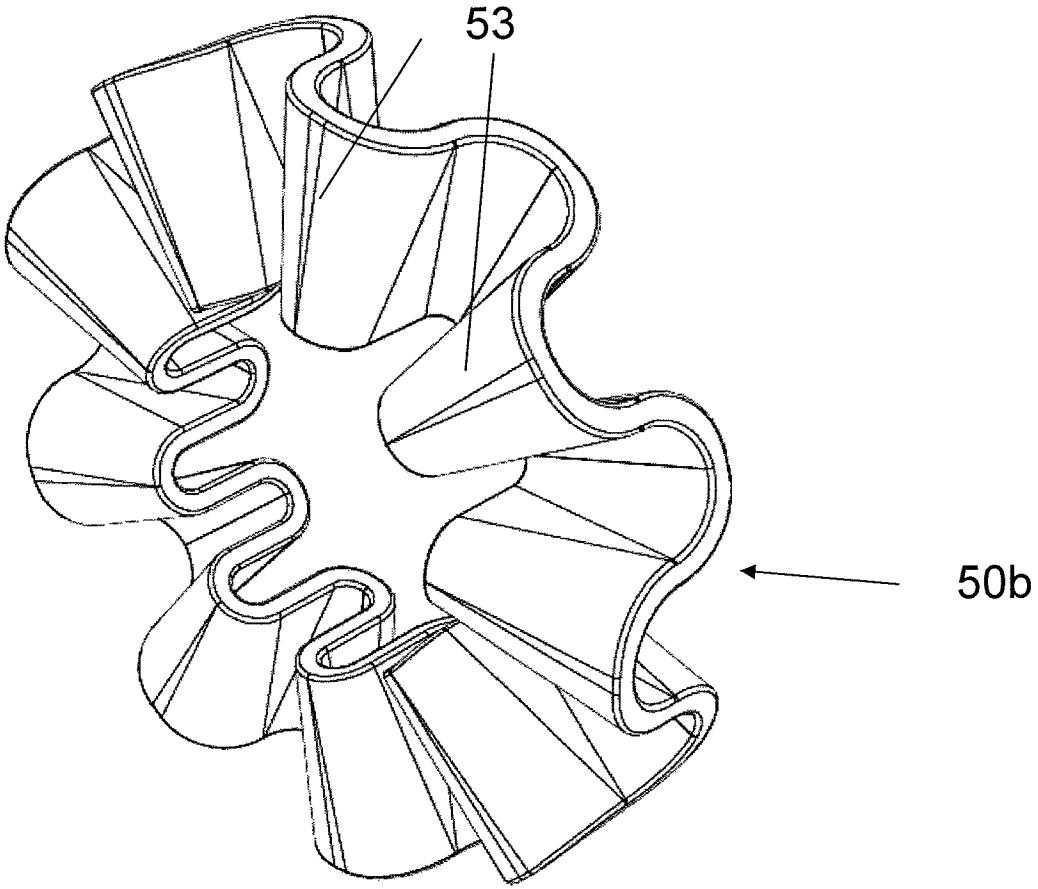
Figure 17:
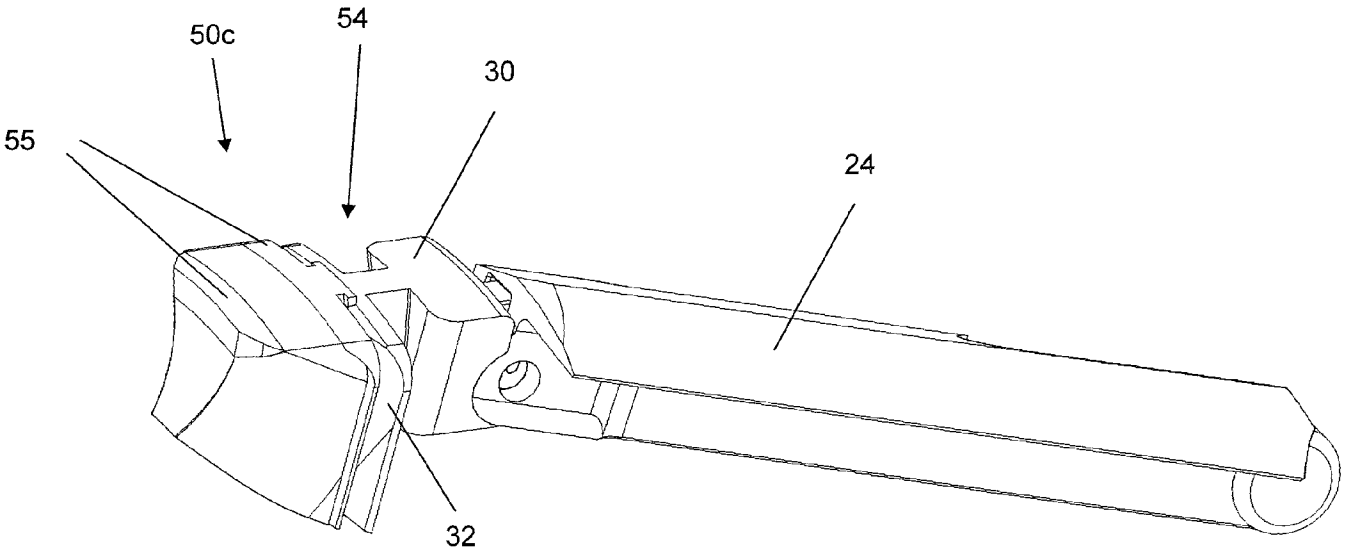

FIG. 12*a* illustrates the configuration of the rear supporting devices of the first packer supporting device in the retracted position;

FIG. 12*b* is similar to FIG. 12*a*, where one front supporting device is provided;

FIG. 12*c* is similar to FIGS. 12*a* and 12*b*, where all front supporting devices are provided;

FIG. 13*a* illustrates the configuration of the rear supporting devices of the first packer supporting device in the expanded position;

FIG. 13*b* is similar to FIG. 13*a*, where one front supporting device is provided;

FIG. 13*c* is similar to FIGS. 13*a* and 13*b*, where all front supporting devices are provided;

FIG. 14 illustrates a side view of some of the front and rear supporting elements of the first and second packer supporting devices in the expanded position;

FIG. 15 illustrates a perspective view of all the front and rear supporting elements of the first and second packer supporting devices in the expanded position;

FIG. 16 illustrates an alternative embodiment of a packer body;

FIG. 17 illustrates an alternative embodiment of a front supporting device, a supporting arm and a packer body.

Figures 1, 2:
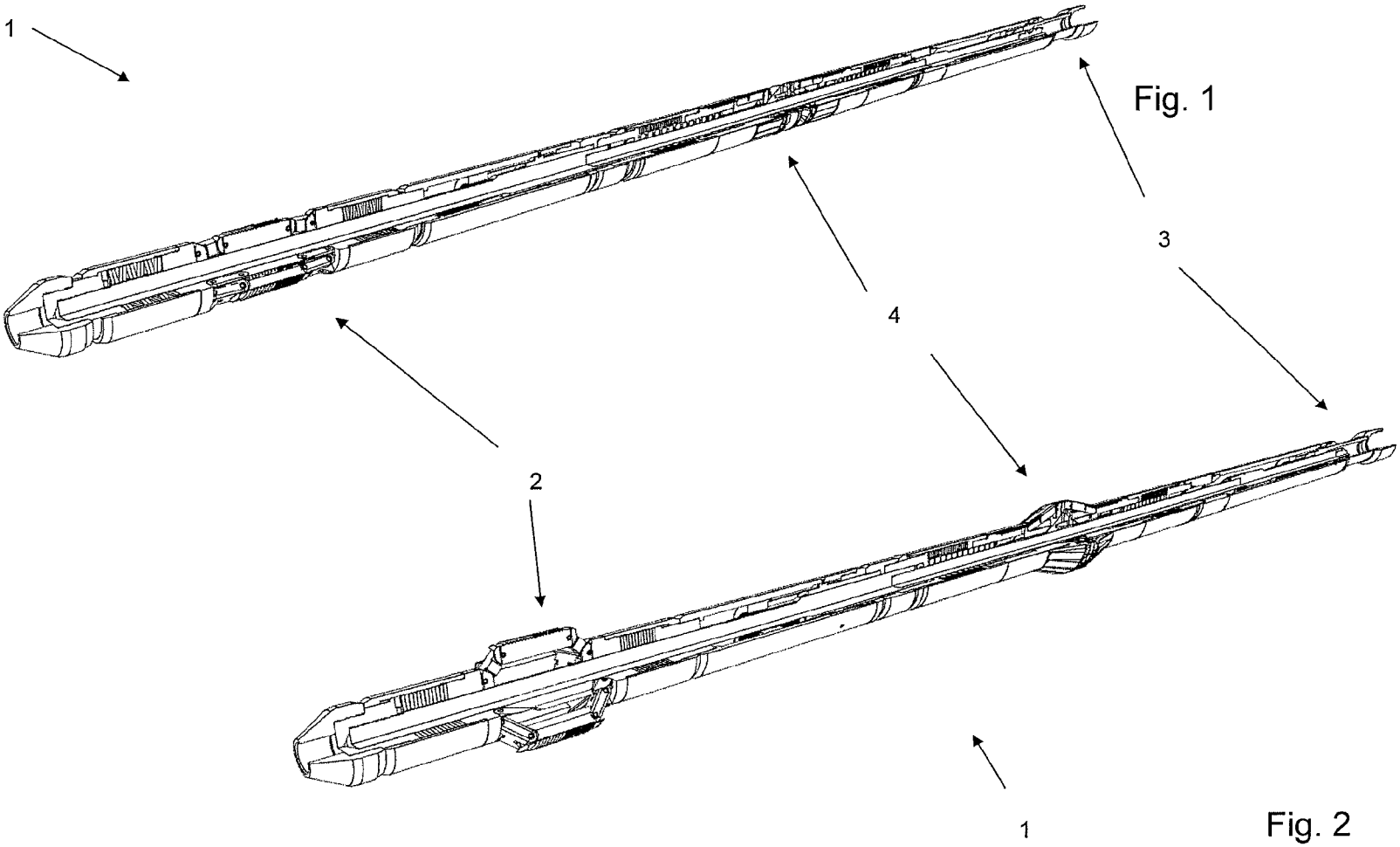
FIGS. 1 and 2 illustrates a perspective view of one embodiment of the plugging device in retracted and expanded position respectively.

It is now referred to FIGS. 1 and 2, illustrating an embodiment of the plugging device 1. The plugging device 1 comprises an anchoring device 2, a connection interface 3 and a packer device 4.

The anchoring device 2 comprises gripping devices for fixation of the plugging device 1 to an inner wall of a pipe (not shown). It should be noted that fluid is allowed to pass the plugging device when the anchoring device 2 is set, i.e. in its expanded state shown in FIG. 2. The anchoring device 2 is considered known for a person skilled in the art, for example from the abovementioned publication U.S. Pat. No. 7,178,602 and will therefore not be described here in detail.

The connection interface 3 is provided for connection to a setting tool for bringing the plugging device from its retracted or "run" position to its expanded or "set" position and for connection to a retrieval tool for retrieving the plugging device again after use. The connection interface 3, the setting tool and the retrieval tool are also considered known for a skilled person, and will not be explained in detail here either.

The packer device 4 is provided for pressure tight sealing of the pipe. It should be noted that the initial design requirement for the plugging device 1 is that it has to pass a restriction with machined inner diameter of 4.125" (i.e. in retracted position) and is to be set in a 7" 35 ppf casing. Moreover, the packer device 4 according to the present invention is to withstand a pressure difference of 5000 psi at a temperature of 170° in the set position. Of course, this initial design requirement does not prevent using the principles of the invention for designing a plugging device for other types of pipes with other diameters, temperatures and pressures.

Figure 3:
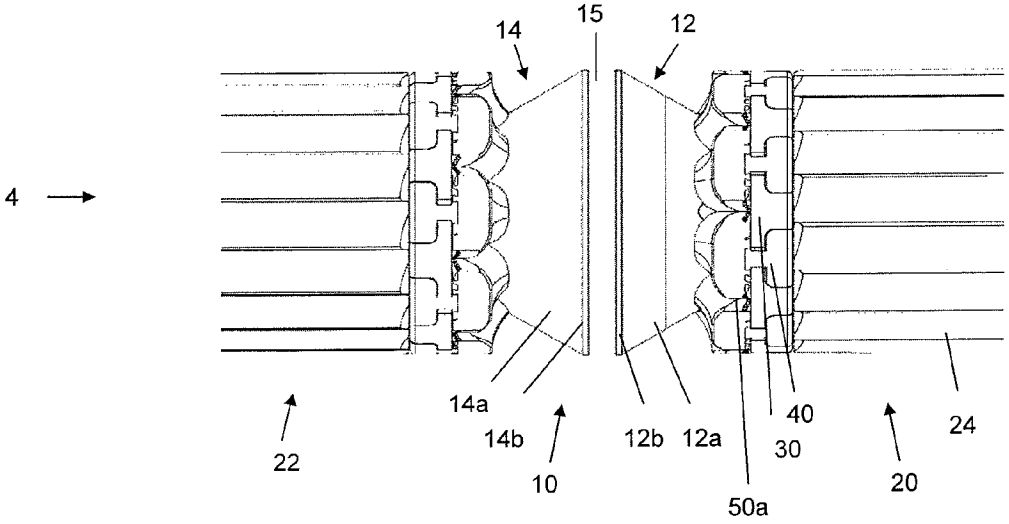
FIGS. 3 and 4 illustrates a side view of the packer device of FIG. 1 in retracted and expanded position respectively.

It is now referred to FIGS. 3-6. The packer device 4 comprises a cone device 10, a first packer supporting device 20 provided on a first side of the cone device 10 and a second a second packer supporting device 22 provided on a second side of the cone device 10, opposite of the first side in the longitudinal direction of the plugging device 1 as shown in FIG. 3.

Figures 5, 6:
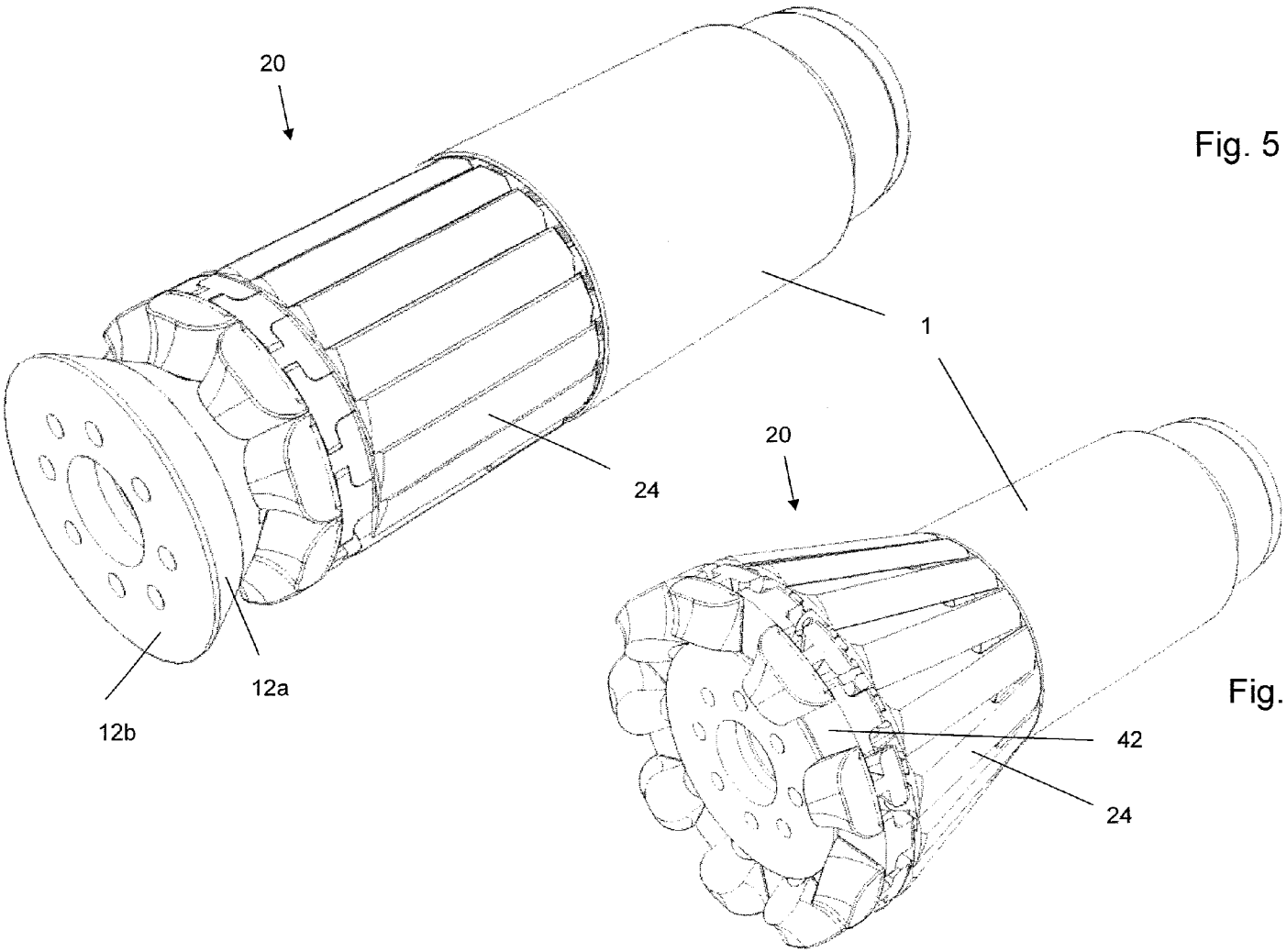
FIGS. 5 and 6 illustrates a perspective view of parts of the packer device of FIGS. 3 and 4 respectively.

The cone device 10 comprises a first cone 12 and a second cone 14, each having their base 12*b*, 14*b* faced towards each other and each comprising a tapering surface 12*a*, 14*a*. In FIG. 3 it can be seen that the base 12*b* is parallel to the base 14*b* and that the bases 12*b*, 14*b* both are perpendicular to the longitudinal direction of the plugging device. In FIG. 5 it is shown that the base 12*b* of the first cone 12 is circular. In the present invention, the tapering surfaces 12*a*, 14*a* are straight.

In an alternative embodiment, it would be possible to provide the cones 12, 14 with an increasingly tapering surface, or a decreasingly tapering surface.

In the present embodiment, the first cone 12 and the second cone 14 is displaceable in an axial direction with respect to each other. A cone packer element 15 is provided between the base of the first cone 12 and the base of the second cone 14. A connection device 16 is provided for radial orientation of the first cone 12 in relation to the second cone 14. The connection device 16 limits the axial displacement of the first cone 12 in relation to the second cone 14.

In the present embodiment, the connection device 16 limits the maximum distance between the base of the first cone 12 and the base of the second cone 14. The compression of the cone packer element limits the minimum distance between the base of the first cone 12 and the base of the second cone 14. However, the connection device 16 may also be used for this purpose. In the present embodiment the connection device 16 comprises at least one screw (see FIG. 7), or by means of other types of connection means 16 well known for a person skilled in the art.

The first and second packer supporting devices 20, 22 of the present embodiment are equal to each other. Each of the first and second packer supporting devices comprises supporting arms 24 having a first end 24*a* movably or pivotably connected to the plugging device 1 and a second end 24*b* movably or pivotably connected to either a front supporting element 30 or a rear supporting element 40. It should be noted that it would also be possible to connect the second end 24*b* of the arm 24 to the front supporting element 30 or the rear supporting element 40 in a fixed way, i.e. they are not movable or pivotable in relation to each other.

Figure 8:
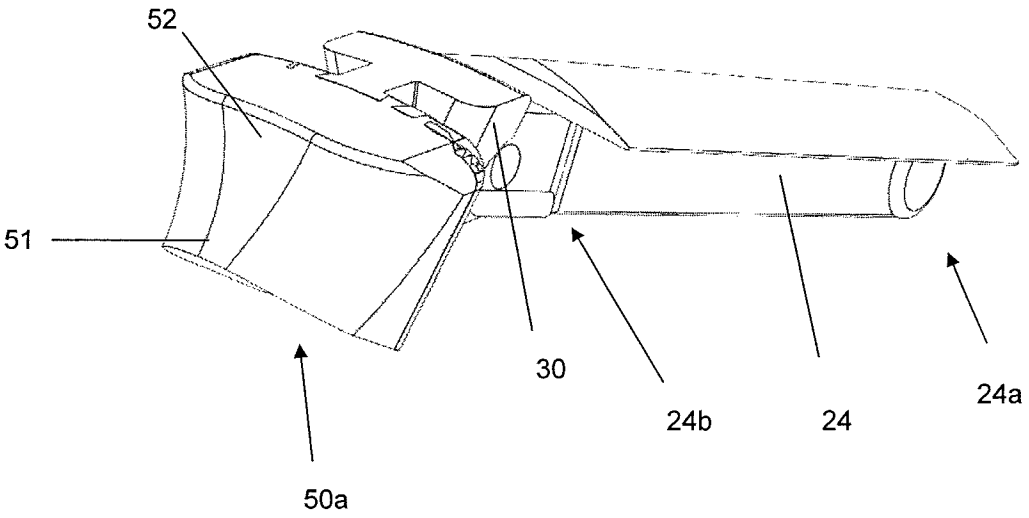
FIG. 8 illustrates a front supporting device with a packer body and a supporting arm.
Figure 10:
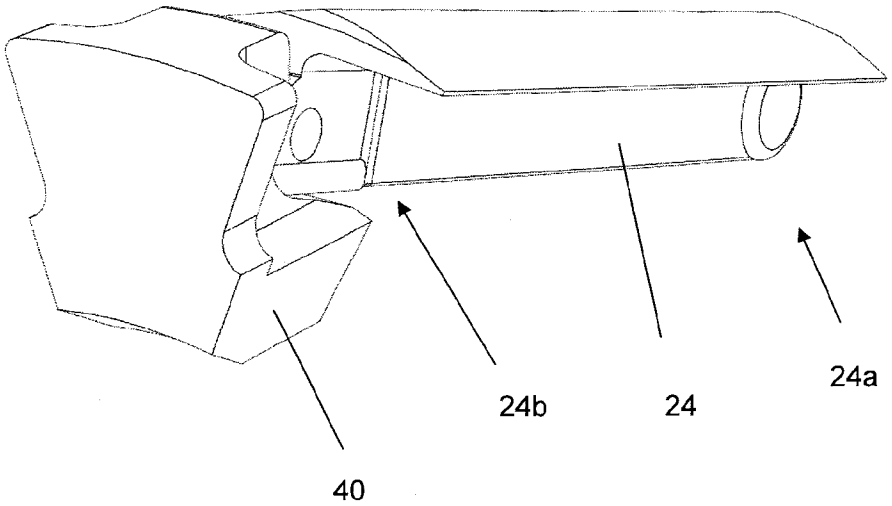
FIG. 10 illustrates rear supporting device and its supporting arm.

In FIG. 8 it is shown a supporting arm 24 having its second end 24*b* pivotably connected to a front supporting element 30. In FIG. 10 it is shown a supporting arm 24 having its second end 24*b* pivotably connected to a rear supporting element 40.

The supporting arm 24 can for example be similar to those described in U.S. Pat. No. 7,178,602. The supporting arms are therefore considered known for a skilled person, and will not be described in detail herein. The supporting arms form a continuous outer surface around the plugging device in the retracted position and during expansion to the expanded position, thereby preventing debris etc in the well flow to block the expansion/retraction process. This can for example be seen in FIGS. 5 and 6.

The pivotation of the supporting arm 24 with respect to the plugging device 1 and the front or rear supporting device 30 or 40 may be provided by a pivotation bolt or any other suitable pivotation mechanism or movable mechanism allowing the supporting arm 24 to move radially out from the plugging device 1.

A sliding surface is provided on the first and second packer supporting device 20, 22. The sliding surface may comprise several sliding surfaces which may be provided on the front supporting device 30 and/or rear supporting device 40. Alternatively, sliding surfaces could also be provided on other parts of the first and second packer supporting devices 20, 22, for example as a part of the supporting arms 24.

Figure 9:
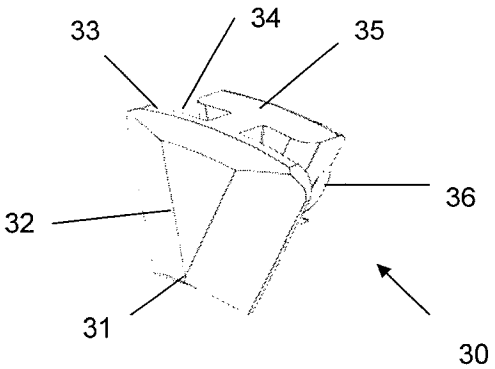
FIG. 9 illustrates a front supporting device of FIG. 8 without the packer body.

The front supporting device 30 will now be described with reference to FIG. 9. The front supporting device 30 comprises a sliding surface 31 for sliding up and down the tapering surface 12*a*, 14*a* of the first or second cone, depending on whether the front supporting device 30 is a part of the first or second packer supporting device 20 or 22 respectively.

The front supporting element 30 further comprises a front surface 32 for supporting a packer body generally denoted with reference number 50. The front surface 32 is faced towards the base of the first and second cones 12, 14. In the present embodiment, since the tapered surface 12*a*, 14*a* of the cones are straight, the front surface 32 is always perpendicular to the longitudinal direction of the plugging device, i.e. both during retraction and expansion. The front surface 32 is at least partially curved.

The front supporting device 30 also comprises a radial outer surface 33. The radial outer surface 33 is curved, the curve preferably having a radius R (see FIG. 13*c*) corresponding to the radius of the casing the plugging device is set in.

The front supporting device 30 also comprises a rear surface 34 provided on the rear side of the front surface 32. The rear surface 34 is substantially planar. On the rear surface 34 a supporting body 35 is provided. When viewed from above in FIG. 9, the supporting body 35 is substantially T-shaped, having a stem 35*a* and a cross bar 35*b*. A connection interface 36 for pivotably connection to the supporting arm 24 is provided as a part of the cross bar 35*b*, see for example FIG. 14.

Figure 11:
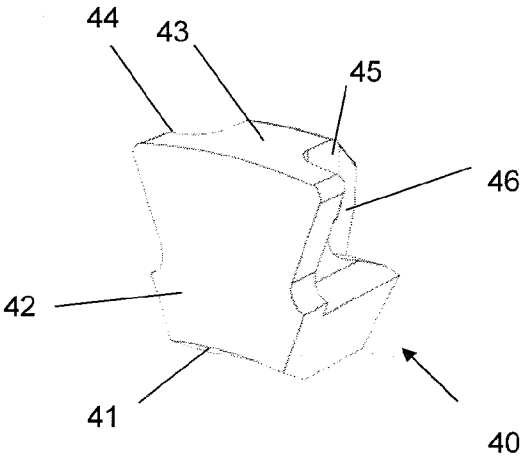
FIG. 11 illustrates the rear supporting device of FIG. 10.

The rear supporting device 40 will now be described with reference to FIG. 11. The rear supporting device 40 also comprises a sliding surface 41 for sliding up and down the tapering surface 12*a*, 14*a* of the first or second cone, depending on whether the rear supporting device 40 is a part of the first or second packer supporting device 20 or 22 respectively.

Moreover, the rear supporting element 40 further comprises a substantially planar front surface 42. The front surface 42 is provided for supporting the rear surface 34 of the front supporting element 30 both in the retracted and expanded positions.

The rear supporting device 40 also comprises a radial outer surface 43. The radial outer surface 43 is curved, the curve preferably having a radius R (see FIG. 13*c*) corresponding to the radius of the casing the plugging device is set in. Hence, in the expanded position showed in FIG. 13*c*, the front and rear supporting devices 30, 40 forms a "torus"-like body having a circular radial outer surface.

The rear supporting device 40 also comprises a rear surface 44 provided on the rear side of the front surface 42. On the rear surface 44 a supporting body 45 is provided. A connection interface 46 for pivotably connection to the supporting arm 24 is provided on the rear surface 44, see for example FIG. 14.

It is now referred to FIG. 12*a-c* and FIG. 13*a-c*. In FIG. 12*a* it is shown that nine rear supporting elements 40 are providing a "torus"-like ring when arranged next to each other. Moreover, the sliding surfaces 41 of the rear supporting elements 40 provide a continuous contact surface towards the cone 12 or 14. In the arrangement shown in FIG. 12*a* it is shown that a slit 49 is formed between two adjacent rear supporting devices 40. The shape of the slit 49 between two such rear supporting elements 40 is configured to receive the stem 35*a* of the front supporting element 30, as shown in FIG. 12*b*.

In FIG. 12*c*, all nine slits 49 have received one front supporting element 30. Here it is shown that the front surface 42 of one rear supporting element 40 is provided at least partially behind the rear surfaces 34 of two adjacent front supporting elements 30 in the retracted position. The front surfaces 42 of the rear supporting elements 40 are supporting the rear surfaces 34 of the front supporting elements 30 in the retracted position.

In FIG. 12*c* it is also shown that the sliding surfaces 31 of the front supporting elements 30 are forming a substantially continuous contact surface towards the cone 12 or 14.

In the expanded position shown in FIG. 13*a*, the distance between the rear supporting elements 40 increases as they slide on the tapering surface of the cone 12 or 14. As shown in FIGS. 13*b* and 13*c*, there is still contact between the front surfaces 42 of the rear supporting elements 40 and the rear surfaces 34 of the front supporting elements 30 in the expanded position. It should also be noted that that the sliding surfaces 31 and 41 of the front and rear supporting elements 30, 40 together provides a substantially continuous surface towards the cone 12 or 14 in the expanded position, as illustrated in FIG. 13*c* by the dashed line A.

Moreover, the radial outer surfaces 33, 43 of the front and rear supporting elements 30 and 40 together forms a substantially continuous radial outer surface as illustrated in FIG. 13*c* by the dashed line B.

From FIGS. 5 and 6 it is clear that every second supporting arm 24 of the first supporting device 20 is pivotably connected to the respective front supporting elements 30 and every second supporting arm 24 is pivotably connected to the respective rear supporting elements 40. This is also the case for the second supporting device 22.

It is now referred to FIGS. 14 and 15. Here it is shown that the first and second packer supporting device 20, 22 are configured so that each front surface 32 of the front supporting elements 30 of the first packer supporting device 20 is faced towards a front surface 42 of the rear supporting elements 40 of the second packer supporting device 22 in the expanded position. Consequently, also each front surface 32 of the front supporting elements 30 of the second packer supporting device 22 is faced towards a front surface 42 of the rear supporting elements 40 of the first packer supporting device 20 in the expanded position.

In FIG. 14 it is shown that the straight dashed line D is going through both the centre of the front surface 32 of the front supporting element 30 and the centre of the front surface 42 of the rear supporting element 40.

In the first embodiment shown in FIGS. 3-8, the packer body 50 comprises packer elements 50*a* provided on the front surface 32 of each front supporting element 30. The packer element 50*a* is made of a ductile material, such as an elastomeric material, a rubber material which may withstand the pressure and temperature required for the well pipe being plugged. The packer element 50*a* may be molded onto the front supporting element 30. In the present embodiment, the radial inner part 51 of each packer element 50*a* is protruding in an axial direction in relation to the radial outer part 52 (see FIG. 8). In this way the radial inner part 51 will be pressed downwards toward the cone device in the expanded position.

Figure 7:
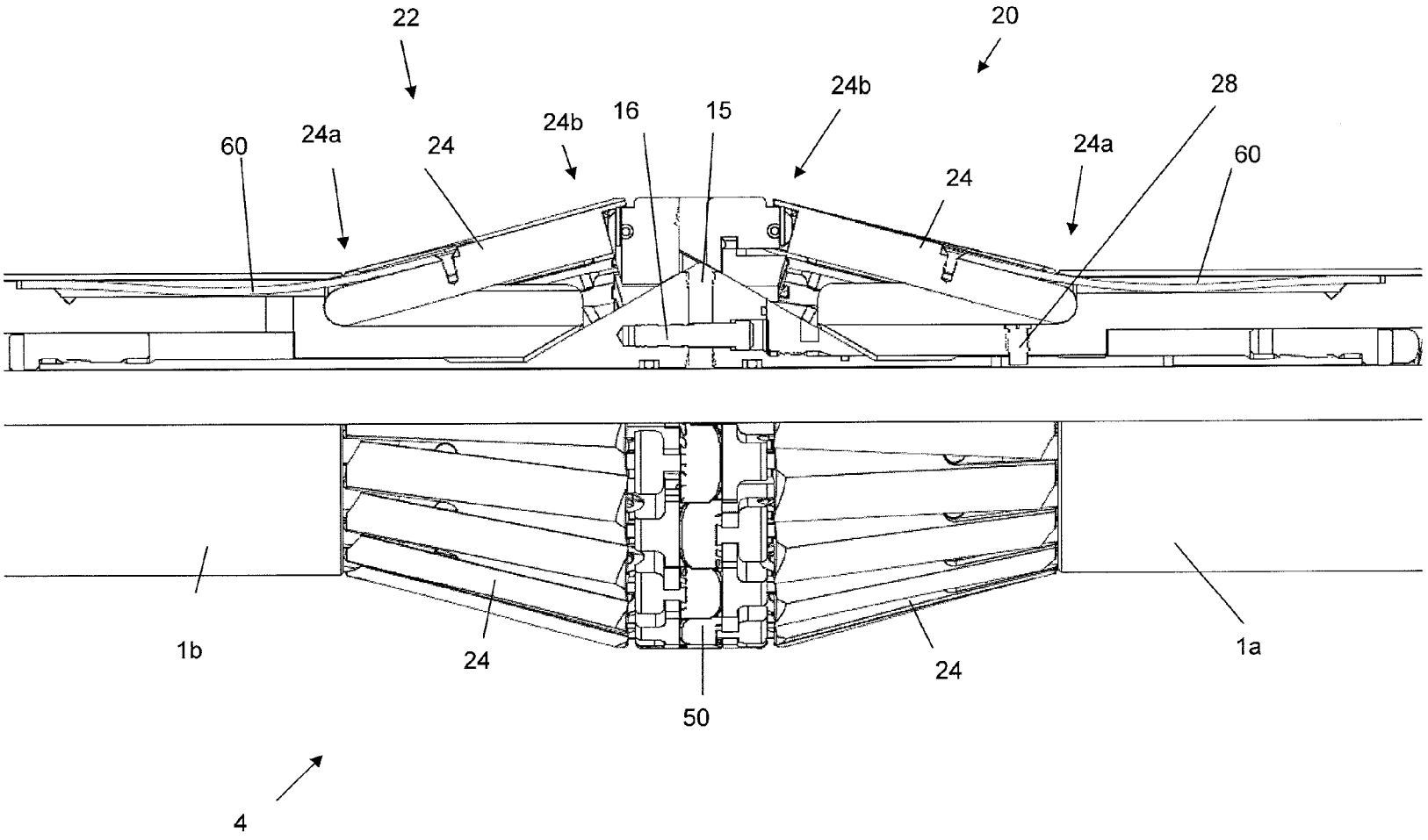
FIG. 7 illustrates a side view of the packer device in expanded position.

The plugging device may also be provided with a guiding system for preventing relative rotation between the first and second packer supporting devices 20, 22 during expansion and retraction. In FIG. 7 it is shown a guiding pin 28 provided in a guiding groove (not shown) preventing a relative rotation between the first and second packer supporting devices 20, 22.

The operation of the packer device 4 will now be described. The packer device 4 is initially in its retracted position. A retracting device 60 (see FIG. 7), for example a spring etc is provided for holding the first and second packer supporting devices 20, 22 in their retracted positions. It should be noted that the packer element 50*a* is not stressed in the retracted position.

For bringing the packer device 4 to its expanded position, a first part 1*a* of the plugging device 1 is pressed towards a second part 1*b* of the plugging device (see FIG. 7), as is known for a skilled person. The guiding system prevents a relative rotation between the first part 1*a* and the second part 1*b*. Consequently, the sliding surfaces 31, 41 of the front and rear supporting elements 30, 40 starts to slide on the tapering surfaces 12*a*, 14*a* of the cones 12, 14 as they pivot with respect to the supporting arms 24.

In the expanded position, the packer element 50*a* is pressed between the front surface 32 of the front supporting elements 30 and the front surface 42 of the rear supporting elements 40. Hence, the front surface 42 of the rear supporting element 40 is configured to support a packer element 50*a* of the opposite packer supporting device 20, 22 when in the expanded position.

Figure 4:
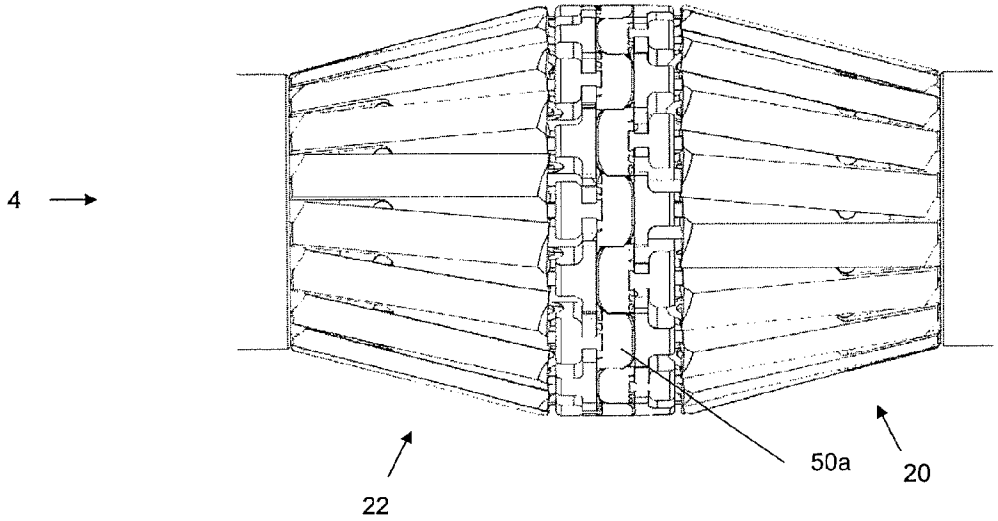

As shown in FIG. 4, the packer elements 50*a* form a continuous packer around the packer device 4, where every second packer element 50*a* is fixed to the first packer supporting device 20 and every second packer element 50*a* is fixed to the second packer supporting device 22.

In FIG. 15 it is shown that the front surfaces 32, 42 together have a form similar to a circular ring. This circular surface forms an extrusion barrier surface for the packer body 50. The packer body 50 will also form a seal towards the pipe in the expanded position. Moreover, the expansion will also provide that the first cone 12 is displaced towards the second cone 14, thereby providing a compression of, and a radial expansion of, the cone packer element 15. Hence, the cone packer element 15 will be pressed towards the packer body 50 along its radial periphery. Hence, a continuous ductile seal is provided in the pipe by the cone packer element 15 and the packer body 50.

In FIG. 14 the central line between the front and rear supporting elements of the respective first and second supporting devices 20, 22 is illustrated by the dashed line C. The curved shape of the front surface 32 of the front supporting elements 30 provides that the opening for the packer body 50 between the first supporting device 20 and the second supporting device 22 is approximately the same around the periphery. Hence, the stress on the packer body 50 is substantially similar around the periphery.

When the packer device 4 is to be retracted, the first part 1*a* of the plugging device 1 is pulled away from the second part 1*b* of the plugging device 1, as is familiar for a skilled person. The sliding surfaces 31, 41 will now slide down on the tapering surfaces of the cones 12, 14 since the retracting device 60 is pressing the supporting arms 24 radially inwards. The first part 1*a* is pulled away from the second part 1*b* until the maximum distance between the base of the first cone 12 and the base of the second cone 14 is reached due to the connection device 16. Then the plugging device 1 has reached the retracted position and may be retrieved from the well pipe.

In the first embodiment described above, the packer body 50 comprised several packer elements 50*a*. However, in a second embodiment, the packer body 50 may be provided as one packer element 50*b*. In FIG. 16 one embodiment of such a packer element 50*b* is illustrated. The packer element 50*b* comprises one continuous packer which is folded to allow it to expand and retract. The packer element 50*b* comprises nine folds 53 which may be fixed to the respective nine front supporting elements 30 of one of the packer supporting devices 20, 22. In yet an alternative embodiment the packer body 50 could comprise two or more such packer elements 50*b*, each fixed to each other and/or the front supporting elements 30 of the first and second packer supporting device 20, 22 respectively.

Another embodiment is illustrated in FIG. 17. Here, the packer body 50 comprises several packer elements 50*c*. The packer elements 50*c* is, as the packer elements 50*a* described above, made of a ductile material. However, in this embodiment each packer element 50*c* is connected to the front surface 32 of the front supporting element 30 by means of a sliding dove-tail joint 54. The packer element 50*c* also provided with pieces 55 of a plastic deformable material, a more rigid material than the ductile material. As shown in FIG. 17, the part of the packer element 50*c* which forms the dovetail joint is made of the plastic deformable material. The dovetail joint 54 allows the packer element 50*c* to slide radially out towards the inner surface of the pipe in the expanded position, to improve the seal in cases where the pipe has been deformed. The dove-tail joint 54 comprises stopping means to limit the radial movement of the packer element 50*c* in relation to the front supporting element 30.

Even though the description above have been focused on a plugging device for hydrocarbon well pipes, it should be noted that the plugging devices could also be used for plugging other types of pipes, for example water pipes etc.

The invention claimed is:

1. A plugging device comprising a packer device for pressure tight sealing of a pipe, the packer device comprising:

a cone device comprising a first cone and a second cone, a first base of the first cone and a second base of the second cone, each of the first base and the second base faced toward one another and each of the first base and the second base comprises a tapering surface;

a first packer supporting device provided on a first side of the cone device;

a second packer supporting device provided on a second side of the cone device;

a packer body provided between the first packer supporting device and the second packer supporting device, wherein the first and second packer supporting devices comprise supporting arms having a first end movably connected to the plugging device and a second end connected to either a front supporting element or a rear supporting element, wherein a sliding surface is provided on each of the first and second packer supporting devices for sliding up and down the tapering surface of the first or second cone, thereby bringing the packer device between an expanded position and retracted position, respectively, and wherein the front supporting element and the rear supporting element comprise front surfaces, wherein the front surfaces are faced towards the first base and the second base and provide an extrusion barrier surface for the packer body in the expanded position.

2. The plugging device according to claim 1, wherein the second supporting arm is connected to the respective front supporting elements and the second supporting arm is connected to the respective rear supporting elements.

3. The plugging device according to claim 1, wherein the second end of the supporting arms is pivotably connected to the respective front supporting element or the respective rear supporting element.

4. The plugging device according to claim 1, wherein the sliding surface comprises a gliding surface provided on each front supporting element and on each rear supporting element.

5. The plugging device according to claim 1, wherein the first and second packer supporting device are configured so that each front surface of the front supporting elements of the first packer supporting device is faced towards the front surface of the rear supporting elements of the second packer supporting device in the expanded position.

6. The plugging device according to claim 5, wherein a guiding system is provided for preventing relative rotation between the first and second packer supporting devices during expansion and retraction.

7. The plugging device according to claim 1, wherein the packer body comprises packer elements provided on the front surface of each front supporting element.

8. The plugging device according to claim 2, wherein the front surface of the rear supporting element is supporting rear surfaces of two adjacent front supporting elements in both the retracted and expanded positions.

9. The plugging device according to claim 8, wherein the front surface of the rear supporting element is provided at least partially behind the rear surfaces of two adjacent front supporting elements in the retracted position.

10. The plugging device according to claim 1, wherein the front surface of the front supporting elements is at least partially curved.

11. The plugging device according to claim 1, wherein a cone packer element is provided between the base of the first cone and the base of the second cone.

12. The plugging device according to claim 11, wherein the first cone and the second cone is displaceable in an axial direction with respect to each other.

13. The plugging device according to claim 11, wherein a connection device is provided for radial orientation of the first cone in relation to the second cone.

14. The plugging device according to claim 13, wherein the connection device limits the axial displacement of the first cone in relation to the second cone.

15. The plugging device according to claim 1, wherein a retracting device is provided for pressing the first or the second or both the first and the second packer supporting devices from the expanded position to the retracted position.

16. The plugging device according to claim 2, wherein the second end of the supporting arms is pivotably connected to the respective front supporting element or the respective rear supporting element.

17. The plugging device according to claim 12, wherein a connection device is provided for radial orientation of the first cone in relation to the second cone.

* * * * *